US007364011B2

(12) United States Patent
Hirschorn et al.

(10) Patent No.: US 7,364,011 B2
(45) Date of Patent: Apr. 29, 2008

(54) ATTENUATING POWER BOOSTER

(76) Inventors: Martin Hirschorn, 420 E. 51st St., New York, NY (US) 10022; John Duda, 28 Barbara Rd., Dumont, NJ (US) 07628; Fred Oran, 14 Oak La., Old Brookville, NY (US) 11545

( * ) Notice: Subject to any disclaimer, the term of this patent is extended or adjusted under 35 U.S.C. 154(b) by 23 days.

(21) Appl. No.: 10/406,760

(22) Filed: Apr. 4, 2003

(65) Prior Publication Data

US 2003/0213643 A1 Nov. 20, 2003

Related U.S. Application Data

(60) Provisional application No. 60/370,416, filed on Apr. 5, 2002.

(51) Int. Cl.

| | |
|---|---|
| ***F01N 7/08*** | (2006.01) |
| ***F01N 7/20*** | (2006.01) |
| ***F01N 1/24*** | (2006.01) |
| ***B60K 13/04*** | (2006.01) |
| *F01N 1/10* | (2006.01) |

(52) U.S. Cl. ..... 181/248; 181/252; 181/256; 180/309; 180/68.3

(58) Field of Classification Search ..... 181/227, 181/249, 252, 255, 256, 222, 228, 248, 247; 180/309, 296, 89.2, 68.3

See application file for complete search history.

(56) References Cited

U.S. PATENT DOCUMENTS

| | | | | |
|---|---|---|---|---|
| 1,934,462 | A * | 11/1933 | Hartsock | 181/248 |
| 2,046,193 | A * | 6/1936 | Spicer | 181/252 |
| 2,292,340 | A * | 8/1942 | McCurdy | 181/250 |
| 2,523,260 | A * | 9/1950 | Campbell | 181/256 |
| 2,583,366 | A * | 1/1952 | Engels | 181/252 |
| 2,640,557 | A * | 6/1953 | Gaffney | 181/256 |
| 2,652,127 | A * | 9/1953 | Johnston | 181/247 |
| 2,929,462 | A * | 3/1960 | Nowak | 181/252 |
| 2,943,695 | A * | 7/1960 | Jeffords | 181/243 |
| 2,987,136 | A * | 6/1961 | Lilley et al. | 181/217 |
| 3,144,913 | A * | 8/1964 | Bailey | 181/248 |
| 3,503,465 | A * | 3/1970 | Yoshihara et al. | 181/252 |
| 3,602,333 | A * | 8/1971 | Kobayashi et al. | 181/252 |
| 3,710,891 | A * | 1/1973 | Flugger | 181/256 |
| 3,957,133 | A * | 5/1976 | Johnson | 181/256 |
| 4,834,214 | A * | 5/1989 | Feuling | 181/249 |

(Continued)

FOREIGN PATENT DOCUMENTS

DE 3843826 A1 * 6/1990

(Continued)

*Primary Examiner*—Edgardo San Martin
(74) *Attorney, Agent, or Firm*—Joseph P. Kincart

(57) ABSTRACT

The present invention includes a power booster pipe suitable for attenuating sound associated with the intake or exhaust of an internal combustion engine and reducing pressure drop associated with movement of gases during operation of the engine. Generally, a diffuser portion is combined with an attenuation portion. One or more tubes of perforated material, such as steel and perforated flutes running the length of the tube increases the surface area of sound attenuating material exposed to combustion gases and the accompanying noise. The perforated flutes and tube can be encircled with sound reducing infill material. A low pressure drop design can be incorporated which includes a gradually increasing diameter tube utilized to route the combustion gases.

11 Claims, 10 Drawing Sheets

U.S. PATENT DOCUMENTS 4,993,513 A * 2/1991 Inoue et al. ..... 181/282
5,058,703 A * 10/1991 Ealba et al. ..... 181/228
5,198,625 A * 3/1993 Borla ..... 181/248
5,892,186 A * 4/1999 Flugger ..... 181/252
6,550,572 B2 * 4/2003 Lin ..... 181/252
6,857,502 B2 * 2/2005 Naito ..... 181/252
2002/0134614 A1 * 9/2002 Chen ..... 181/252

FOREIGN PATENT DOCUMENTS

JP 03264716 A * 11/1991
JP 06042328 A * 2/1994
JP 06081627 A * 3/1994

* cited by examiner

ATTENUATING POWER BOOSTER

CROSS REFERENCE TO RELATED APPLICATIONS

This application claims priority to the Provisional Application Ser. No. 60/370,416, filed Apr. 5, 2002. The contents of which are relied upon and incorporated by reference.

BACKGROUND

This invention relates generally to a method and apparatus for facilitating the reduction of pressure drop and sound. In particular, the present invention relates to methods and apparatus for reducing noise with a combustion engine and increasing the efficiency of extracting gases from a chamber.

Mufflers are commonly used for the reduction of machine generated noise levels such as those associated with the operation of an internal combustion engine typically used to power an automobile, lawn equipment, or commercial power equipment.

An internal combustion engine produces noise as a result of explosions occurring in within the cylinder during operation. The explosions coupled with high fluid velocities of the hot exiting gas result in a noisy, exhaust gas that must be directed away from the operating engine. It is known that controlling the amount and variance of back pressure caused by exiting gases is important to efficient operation of an internal combustion engine.

Typically, combustion gases, which can include intake air, an air fuel mixture, and exhaust gases, are made to flow through multiple chambers and sometimes through sound deadening materials to reduce noise caused by the engine. A plurality of separate tubes have been used in generally parallel relationship on a plurality of transversely extending baffles. Failure to remove exhaust gases form the engine quickly results in a back pressure which is exerted on the operating engine and can reduce performance of the engine. Thus, it is desirable not only to reduce the noise levels associated with the combustion gases, but also to effectuate a reduction in back pressure to increase the overall efficiency of an internal combustion engine, or other exhaust gas producing machinery.

A typical prior art muffler can include internal baffles to create an expansion chamber and low frequency resonating chambers. Various techniques are known in the prior art to increase performance. Techniques can include adjusting a length of exhaust pipe and/or muffler to conform to a typical sinusoidal noise pulse produced by the operating internal combustion chamber. Exhaust system lengths can also include various length "headers" tuned specifically to a particular engine design. An optimum length can reduce back pressure of the noisy, gaseous exhaust. However, such tuned headers to not provide significant noise reduction. What is needed is a device capable of improving the sound deadening qualities of an exhaust system while simultaneously improving overall performance of an internal combustion engine attached thereto.

SUMMARY

Accordingly, the present invention provides sound attenuating apparatus for attenuating noise associated with a combustion engine. Noise is attenuated by routing combustion gases through a first perforated tube having a first diameter and which is contained within a second perforated tube having a second diameter which is greater than the first perforated tube, the second perforated tube located concentrically around the first perforated tube. Flutes can be formed into the first perforated tube extending outward from the first perforated tube towards the second perforated tube. A diffuser portion can be combined with, or otherwise connected to, an inlet end of the first perforated tube. The diffuser portion can include an outlet end which connects to inlet end of the first perforated tube. The diffuser portion can be formed from a solid walled tube and the diameter of the solid walled tube at an inlet end being less than the diameter at the outlet end. An outer solid wall tube can be located concentrically around the outer surface of the second perforated tube and solid side walls can be located at either end of the second perforated tube and the solid walled tube to encase the perforated tubes. An opening through the center of the solid side walls can allow the inner perforated tube to connect to the diffuser portion and a tail portion.

Some embodiments can include a first perforated tube with an inlet end and an outlet end connected to a diffuser portion with also with an inlet end and an outlet end. The outlet end of the diffuser portion can be connected to the inlet end of the first perforated tube. The diffuser portion can include a solid walled tube with a diameter at the inlet end of the diffuser portion that less than the diameter at the outlet end of the diffuser portion. An outer solid walled tube having a diameter greater than the perforated tube can be located concentrically around the perforated tube and infill material can be contained within the outer solid walled tube and about the perimeter of the perforated tube. Side walls can be connected at either end of the second perforated tube and the solid walled tube to encase the perforated tube and infill material within the dies walls and solid wall tube. Each side wall can have an opening through which the perforated tube can connect to the diffuser portion and a tail portion.

Some embodiments can also include a sound attenuating apparatus with a first perforated tube of generally a conical shape with a diameter opening that is smaller at one end of the tube and larger at the other end of the tube. An outer solid walled tube can have a diameter greater than the perforated tube and be located concentrically around the first perforated tube. Side walls at either end of the second perforated tube and the solid walled tube with an opening through the center of the solid walls through which the inner perforated tube connects to an entry portion and a tail portion. Some embodiments can also include a second perforated tube located concentrically around the first perforated tube and generally following the shape of the first perforated tube with the diameter of any portion of the second perforated tube proportionately larger than the first perforated tube;

A method for practicing the present invention can include placing an apparatus designed according to the inventive concepts described herein in the path of the combustion gases. The surface area of any flutes incorporated into the apparatus can be increased or otherwise adjusted until a desired or required amount of sound attenuation is accomplished. Sound attenuation can also be adjusted according to the particular taste of a user.

Other embodiments are described in the following figures, description and claims.

DETAILED DESCRIPTION

The present invention includes a power booster pipe 100 suitable for attenuating sound associated with an internal combustion engine, such as, for example, sound associated with the intake and exhaust of combustion gases. In some embodiments, a power booster pipe according to the present invention generally comprises a tube of perforated material, such as steel, and perforated flutes formed into the tube and running the length of the tube. An increase in the surface area of perforated material exposed to exhausted gas increases attenuation of the accompanying noise. The perforated flutes and tube can also be encircled with sound reducing infill material. Generally, an unrestricted straight through tube can be used to limit energy loss that may result from needing to push the exhaust gas through an exhaust pipe. Embodiments of the present invention also include a low pressure drop design incorporating a gradually increasing diameter of the tube, which can result in boosting performance and efficiency of a combustion engine.

Figure 1:
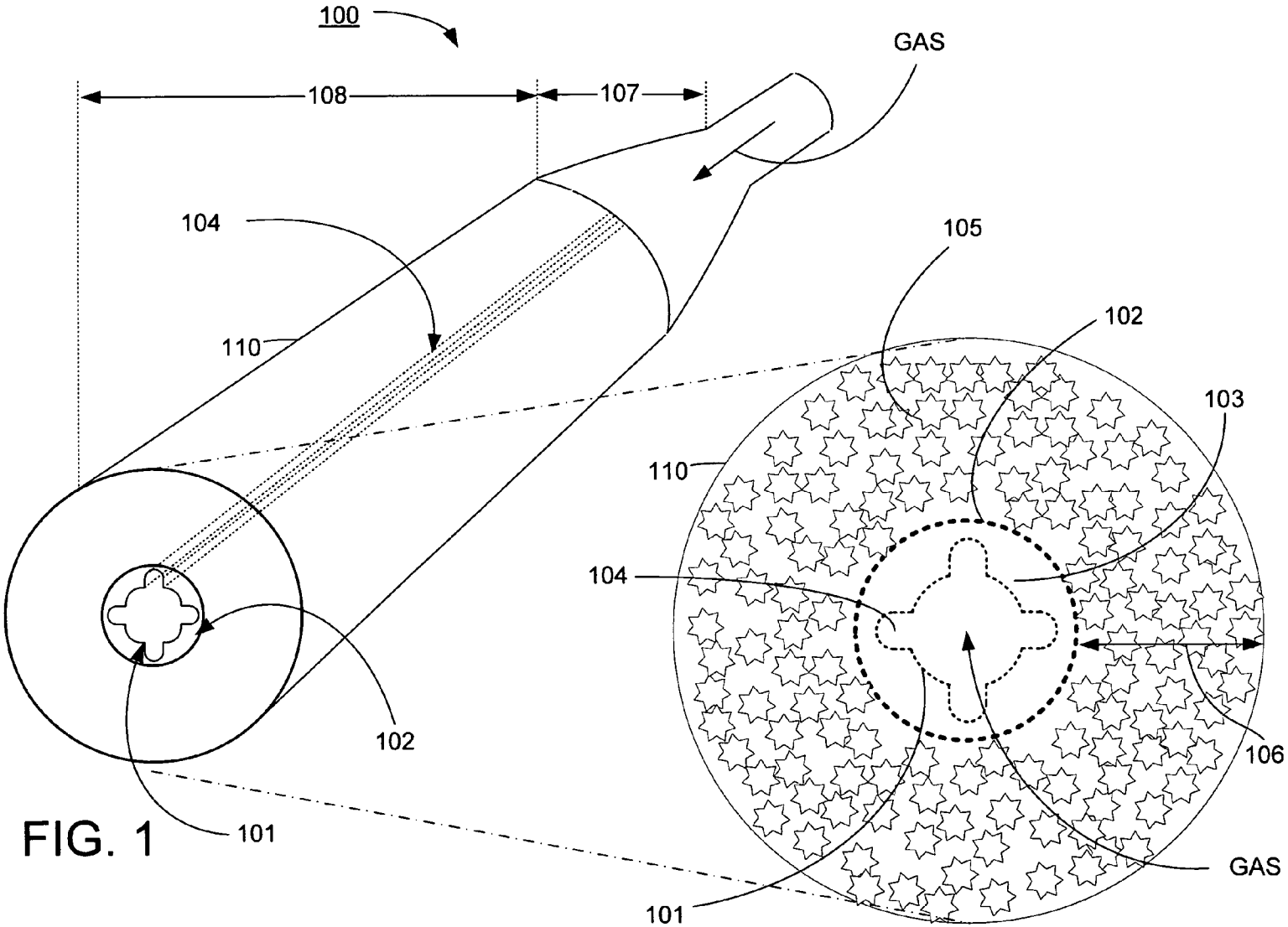
FIG. 1 illustrates a perspective and cut away view of a device implementing some embodiments of the present invention.

Referring now to FIG. 1, a profile cutaway and perspective view of some embodiments of the present invention is illustrated. The illustrated embodiments can include an attenuating power booster pipe 100 with an inner tube 101 and an outer tube 102. The inner tube 101 and outer tube 102 can be perforated. The perforations can allow combustion gases traversing the respective tubes 101 and 102 to pass through the wall of the tubes.

A diffuser portion 107 can include an increase in diameter size incorporated in the attenuating power booster pipe 100 prior to the sound reducing portion 108 of the attenuating power booster pipe 100 which includes the inner tube 101, the perforated tube 102 and infill 105. An increase in the diameter size incorporated into the diffuser can result in a power boost, or in other terms, a decrease in the amount of power required to move the combustion gases through the power booster pipe 100.

In some embodiments, the inner tube 101 can include one or more flutes 104 which run along the length of the inner tube 101. Embodiments can include the flutes projecting outward from the inner tube 101. Embodiments can also include one or more flutes 104 which run along the entire length of inner tube 101 or which run along some portion of the inner tube 101.

A solid wall tube 110 can enclose the inner tube 101, the outer tube 102, the diffuser portion 107 and the fill 105. The solid wall tube 110 acts as a protective cover to the infill 105.

The power booster pipe 100, inner tube 101, outer tube 102, diffuser portion 107 can be fashioned from any suitable material that is resistant to heat, corrosion and stresses associated with internal combustion engine applications, such as, for example steel, Cypriot steel or stainless steel, ceramic, manmade composites or other man made material.

Generally, embodiments of the present invention can include any size diameter tubes appropriate to a particular use. The empty space between the larger perforated tube and the smaller perforated tube can serve to modify the sound characteristics and also reduce the mechanical stress of the combustion gas on the infill 105 packing. The size and quantity of perforations can be varied in any or all the perforated material. Varying the size and quantity of perforations can result in variation of tone and the amount of sound reduction. In addition, the length of the tubes, and/or the number and size of flutes can be adjusted according to the size of the frequency of the sound waves that the power booster pipe 100 is seeking to attenuate.

The surface area of the flutes will generally increase the sound attenuation provided by the power booster pipe 100. The surface area can be increased, for example, by increasing the number of flutes and/or the size of the flutes.

The perforations in any embodiment can be through the material comprising the tube and be generally through out the body of the tube. Perforations can include any shape such as, for example a circular, square, rectangular or other shape including irregular shapes. Spacing between perforations can be even or irregular. Sizing of perforations can also vary or be uniform. Perforation size can also vary according to the size of the tube, type of combustion gas, intensity and frequency composition of residual noise, an amount of noise, or other factors. Some embodiments, such as those designed for use with small combustion engine may have perforations, for exemplary purposes only and not limiting the invention, of as small as 1/16 of an inch. The percentages of the perforated face may vary since they can effect power booster pipe 100 noise reduction characteristics and residual noise. Size of perforations can be larger or smaller depending upon the size of an application.

Figure 2A:
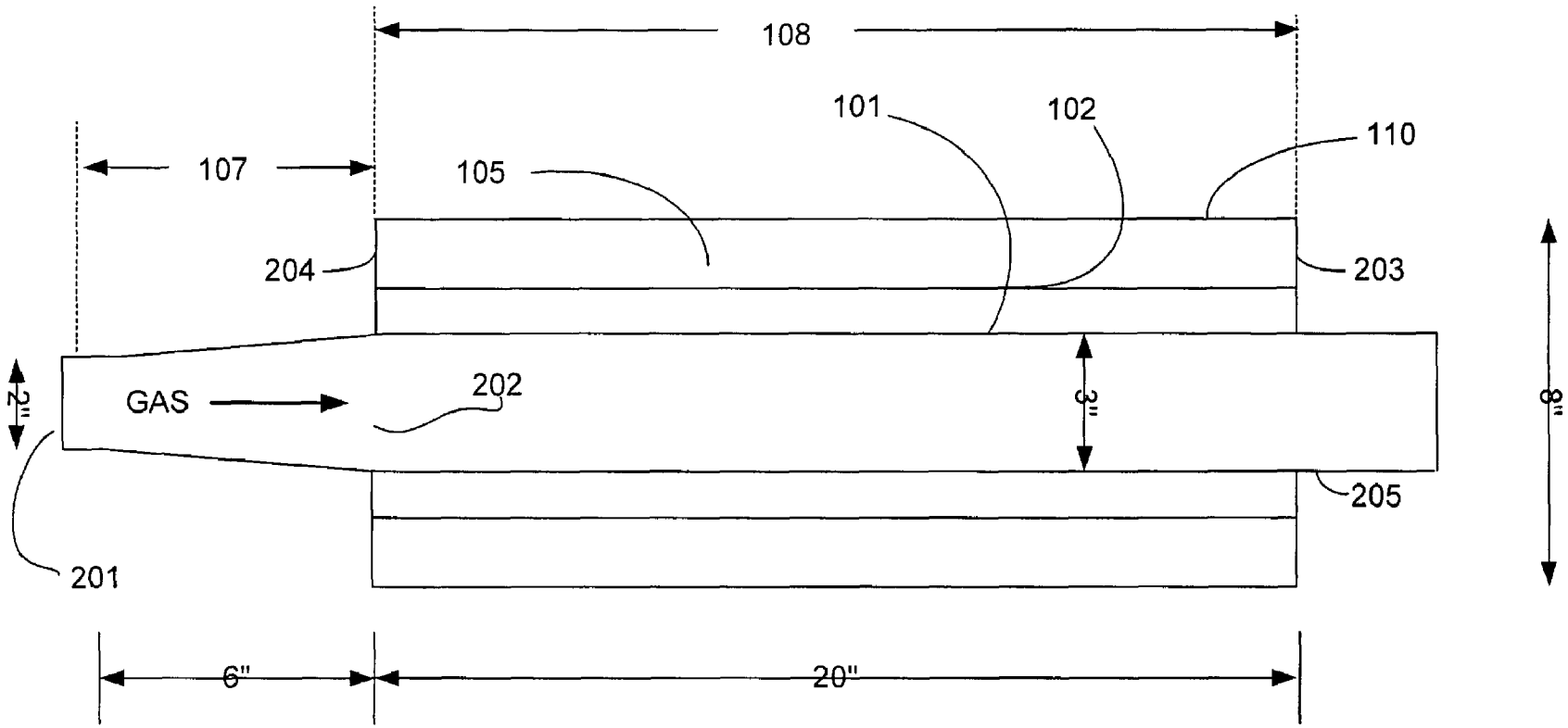
FIG. 2A illustrates a profile view of a device implementing some embodiments of the present invention utilizing a first perforated tube and a second perforated tube.

Referring now to FIG. 2, a diffuser portion 107 can be located prior (along the path of the combustion gas) to the sound reducing portion of the power booster pipe 100 which includes a first perforated tube 101 and a second perforated tube 102 and infill 105. The diffuser portion 107 can be located outside of the side wall 204 and connect the power booster pipe 100 to an intake or exhaust system. In these embodiments, the diffuser portion 107 increases from a smaller diameter at an inlet end to a larger diameter at an outlet end, such as, for example, a smaller diameter 201 of approximately 2 inches at an combustion gas inlet end to a larger diameter of approximately 3 inches at the combustion gas outlet end 202 connected to the inner tube 101.

Other dimensions, that can be included in some embodiments can include, a diffuser portion 107 that is approximately 6 inches long and a sound reducing portion 108 that is approximately 20 inches long. The diameter of the solid wall tube 110 can be approximately 8 inches.

The power booster pipe 100 can also include side walls 203-204. The side walls 203-204 can connect the solid wall tube 110 to the outer perforated tube 102 and the inner tube 101 and provide structural support to the relative position of each the inner tube 101 and the outer tube 102. The side wall 203-204 can seal the ends of the outer perforated tube 102 and the solid walled tube 110 and have an opening at its center through which the inner perforated tube can connect to the diffuser 107 and a tail portion 205.

Figure 2B:
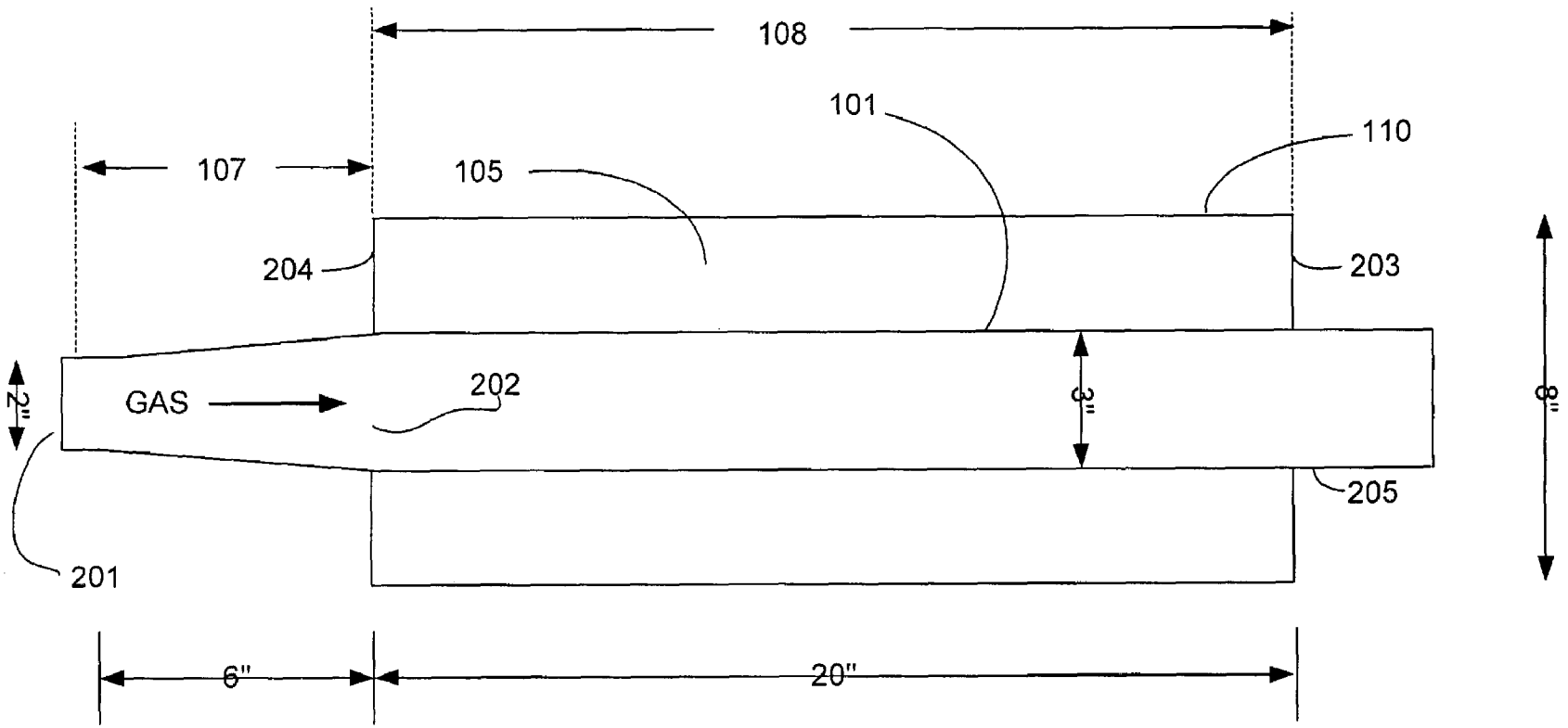
FIG. 2B illustrates a profile view of a device implementing some embodiments of the present invention utilizing one perforated tube.

Referring now to FIG. 2B, some embodiments can include a first perforated tube 101 with no second perforated tube 102. In these embodiments, infill 105 can be packed around the first perforated tube 101 out to the solid wall tube 110.

Figure 3:
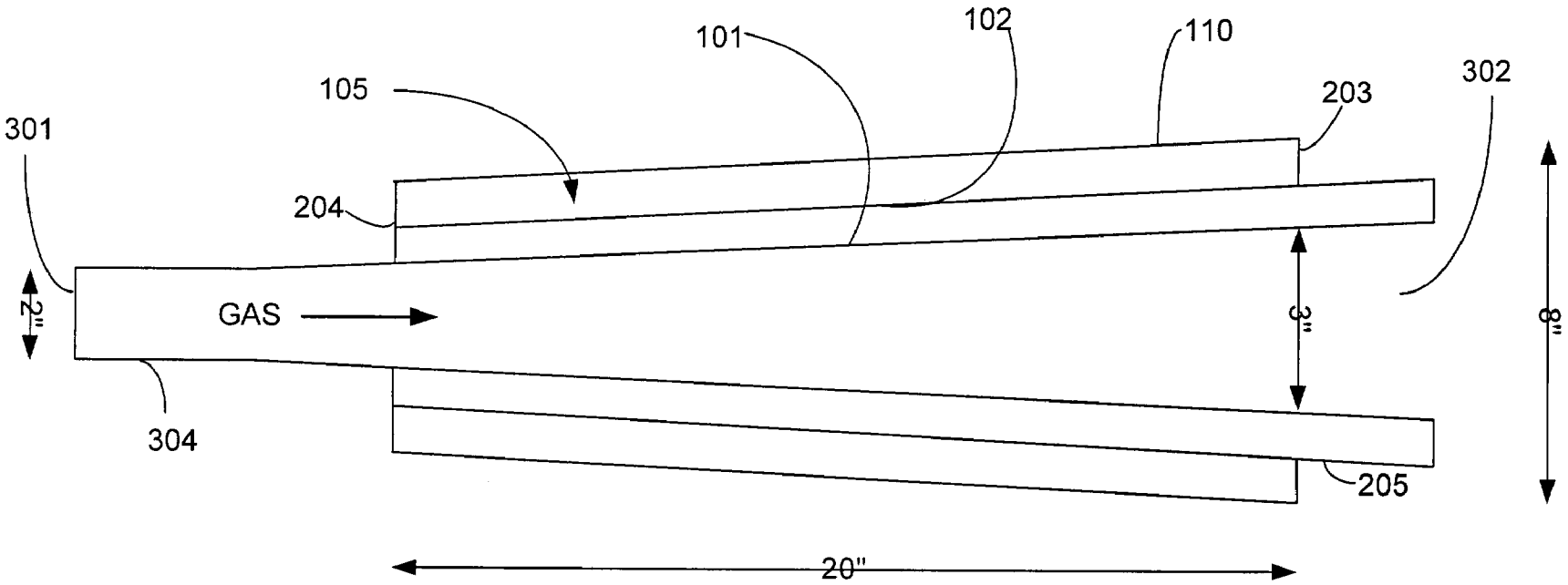
FIG. 3 illustrates a cross section diagram of some embodiments comprising an inner perforated tube with increasing diameter.

Referring now to FIG. 3 a profile cutaway view of still other embodiments of the present invention is illustrated. In these embodiments, the diameter of the sound reducing portion of the power booster pipe 100 that includes the perforated tubes 101 and 102 and infill 105 increases from a smaller diameter to a larger diameter, such as, for example, a smaller diameter 301 of 2 inches at a combustion gas inlet end to a larger diameter of 3 inches at an combustion gas outlet end 302. Different embodiments can include the increase in diameter as a gradual constant or as a stepped increase (not illustrated.

Variations can include, for example, outward flutes 104 formed into the inner tube 101, with a diameter of 2 inches, that extend to the inner wall of a larger concentric perforated outer tube 102, such as a 3 inch or 4 inch perforated tube. Variations can include, for example, outward flutes 104 that extend to the inner wall of a larger concentric perforated tube, such as a 3 inch or 4 inch perforated tube. A larger diameter solid wall tube, such as a 7 inch solid wall tube, can also be concentric with the 3 inch perforated tube. Infill 105 can be packed in-between the 3 inch perforated tube and the 7 inch solid tube. A still larger diameter solid wall tube 110, such as a 7 inch solid wall tube, can also be concentric with the 3 inch perforated outer tube 102. Infill 105 can be packed in-between the outer tube 102 and the 7 inch solid tube 110. Additional embodiments and variations are further discussed below.

Such embodiments of the present invention can also include an entry portion 304 and side walls 203-204. The side walls 203-204 can connect the solid wall tube 110 to the outer perforated tube 102 and the inner tube 101 and provide structural support to the relative position of each the inner tube 101 and the outer tube 102. The side wall 203-204 can seal the ends of the outer perforated tube 102 and the solid walled tube 110 and have an opening at its center through which the inner perforated tube can connect to the entry portion 303 and a tail portion 205.

The entry portion 304 can connect the power booster pipe 100 to an intake or exhaust system in order to receive combustion gases.

Figure 4A:
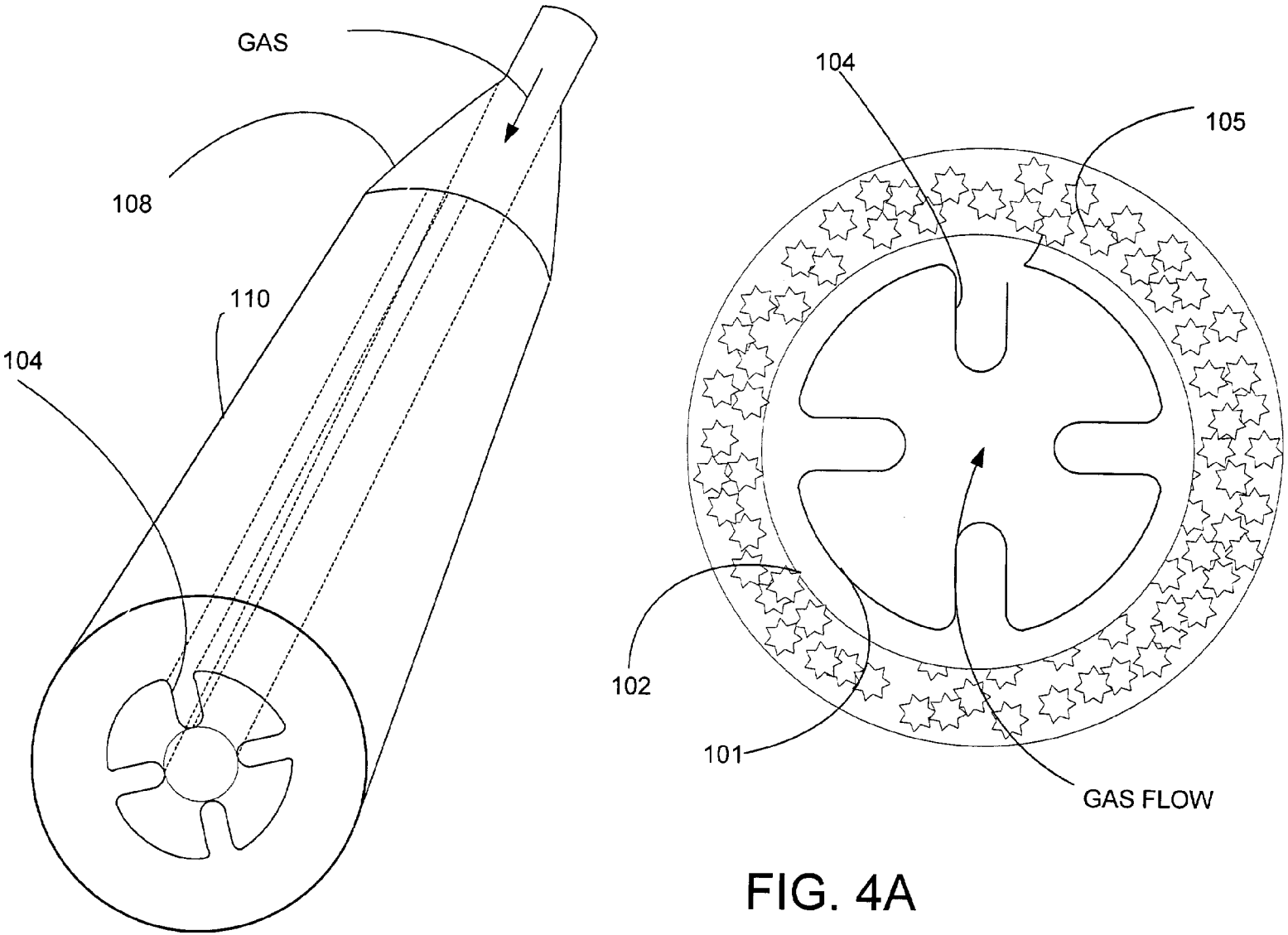
FIG. 4A illustrates a cross section diagram that can embody this invention incorporating an inner diffuser tuber and a fluted channel filled or perforated material with sound reducing infill 105.

Referring now to FIG. 4A, an illustrated embodiment includes an inner tube 101 which is positioned inside of a larger diameter outer tube 102. Some embodiments can include inner tube 101 with one or more flutes 104 formed into the inner tube 101 that extend inward (as illustrated) towards the center of the power booster pipe 100. Some embodiments can also include flutes 104 extending outwards towards the perimeter of the power booster pipe 100. In some embodiments, the outer tube flutes 104 can extend from outer tube 102 to the perimeter of the inner tube 101 and run the length of the tube. The outer tube flutes 104 can be utilized to improve acoustical performance and also tune residual sound qualities of the power booster pipe 100. For the purposes of this application, residual sound can be the noise emanating out of the combustion engine or the exhaust pipe. In some embodiments, the flutes can provide support to the inner tube 101 by fixing the inner tube 101 concentrically within the outer tube 102.

Figure 4B:
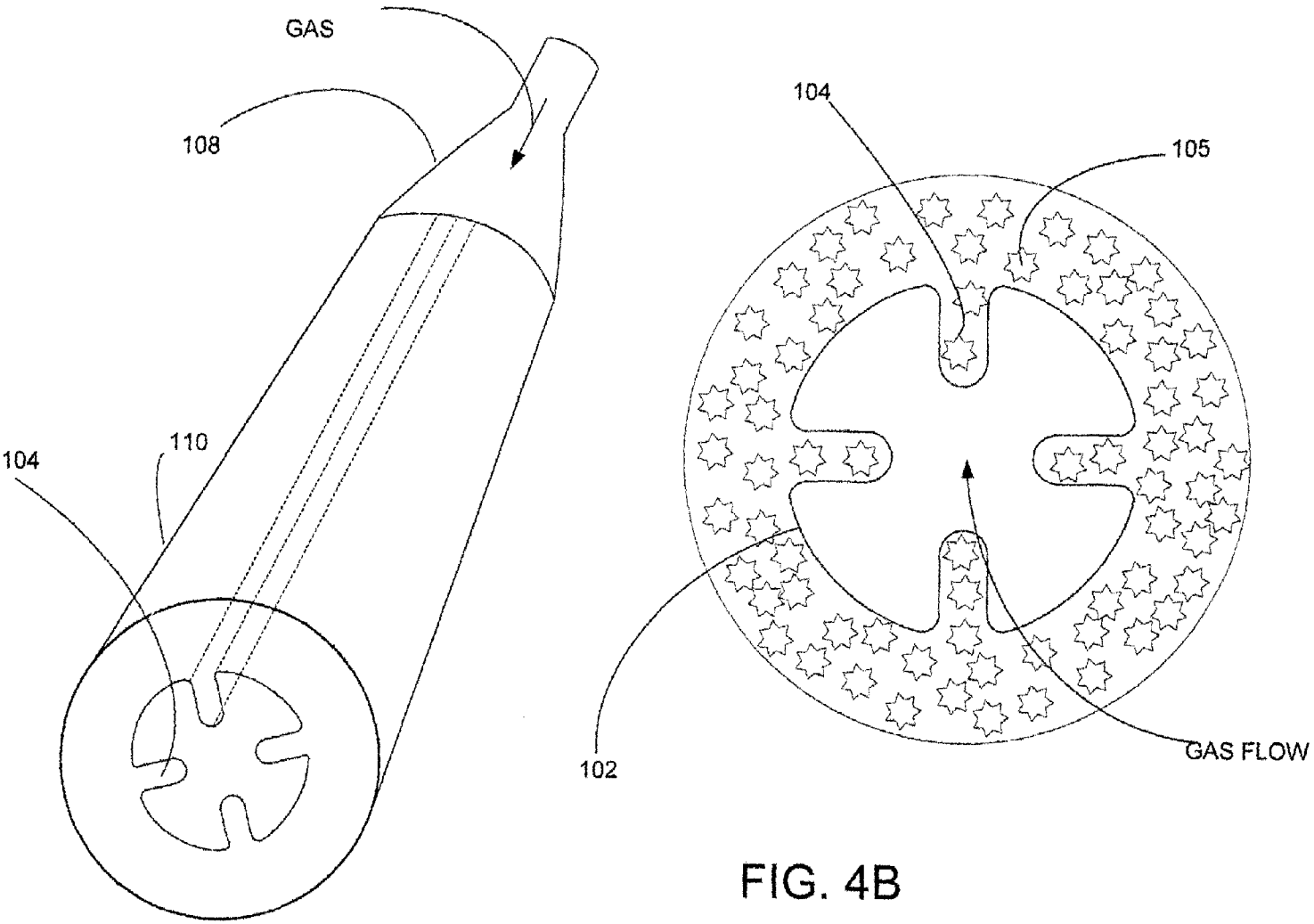
FIG. 4B illustrates a cross section diagram that can embody this invention incorporating a fluted channel filled or perforated material with sound reducing infill 105 without an inner diffuser tube.

Referring now to FIG. 4B, still other embodiments can include the larger fluted tube without the inner smaller perforated tube. Embodiments without the inner smaller tube may promote further increased efficiency and also promote different residual sound qualities.

A larger fluted outer tube 102, such as, for example, a 4 inch fluted tube can also be concentrically contained within a still larger solid wall tube 107, such as a 7 inch solid wall tube 107. The solid wall tube 107 can be constructed of a solid material, such as steel, and not contain perforations. Some embodiments of the present invention can include, for example, space between the 4 inch fluted outer tube and the 7 inch diameter tube that is packed with an infill 105 material useful in sound reduction or that is left void.

Infill 105 material can include, for example, a fiberglass material, steel wool, such as stainless steel wool, mixture of fiberglass and steel wool, or other material or combination of materials which may impart desirable sound reduction or sound modification. In some embodiments a certain tone may be desired and an amount and type of infill 105 material can be tailored to the desired sound. Generally, embodiments incorporating flutes packed with sound reducing material will provide increased sound reduction qualities.

Figure 5:
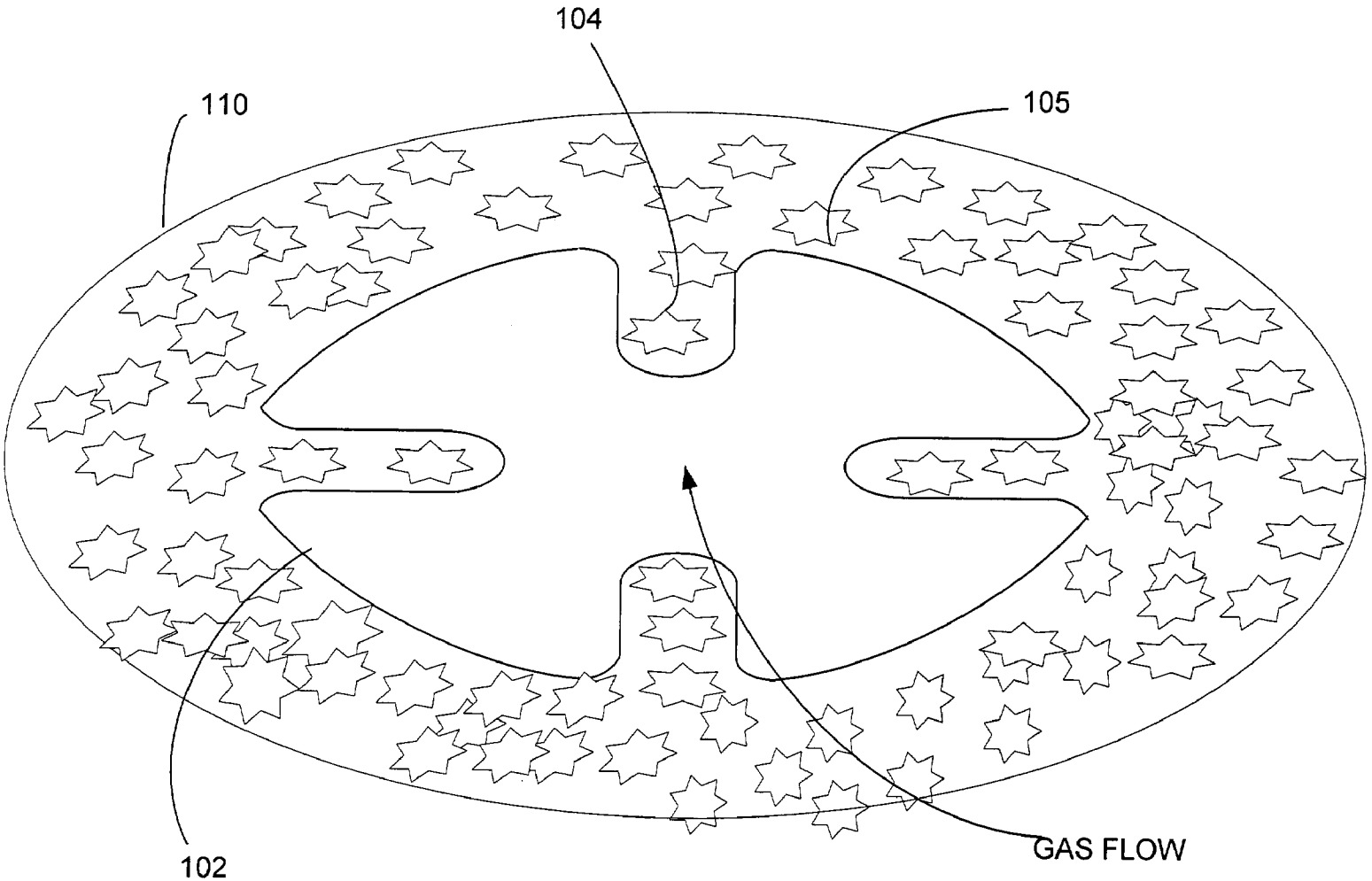
FIG. 5 illustrates a cross section diagram that can embody this invention incorporating an oval fluted channel filled or perforated material with sound reducing infill.

Referring now to FIG. 5, the present invention can include numerous different shapes, including round and oval embodiments as illustrated, or other desirable shape. Changing shape can be useful to accomplish a desirable tone or other quality of residual noise. An oval shape may provide more depth for low frequency residual noise. Accordingly, some embodiments can include an oval or round outer tube 102, and oval solid wall 110, with inward (as illustrated) or outward directed flutes 104.

Figure 6:
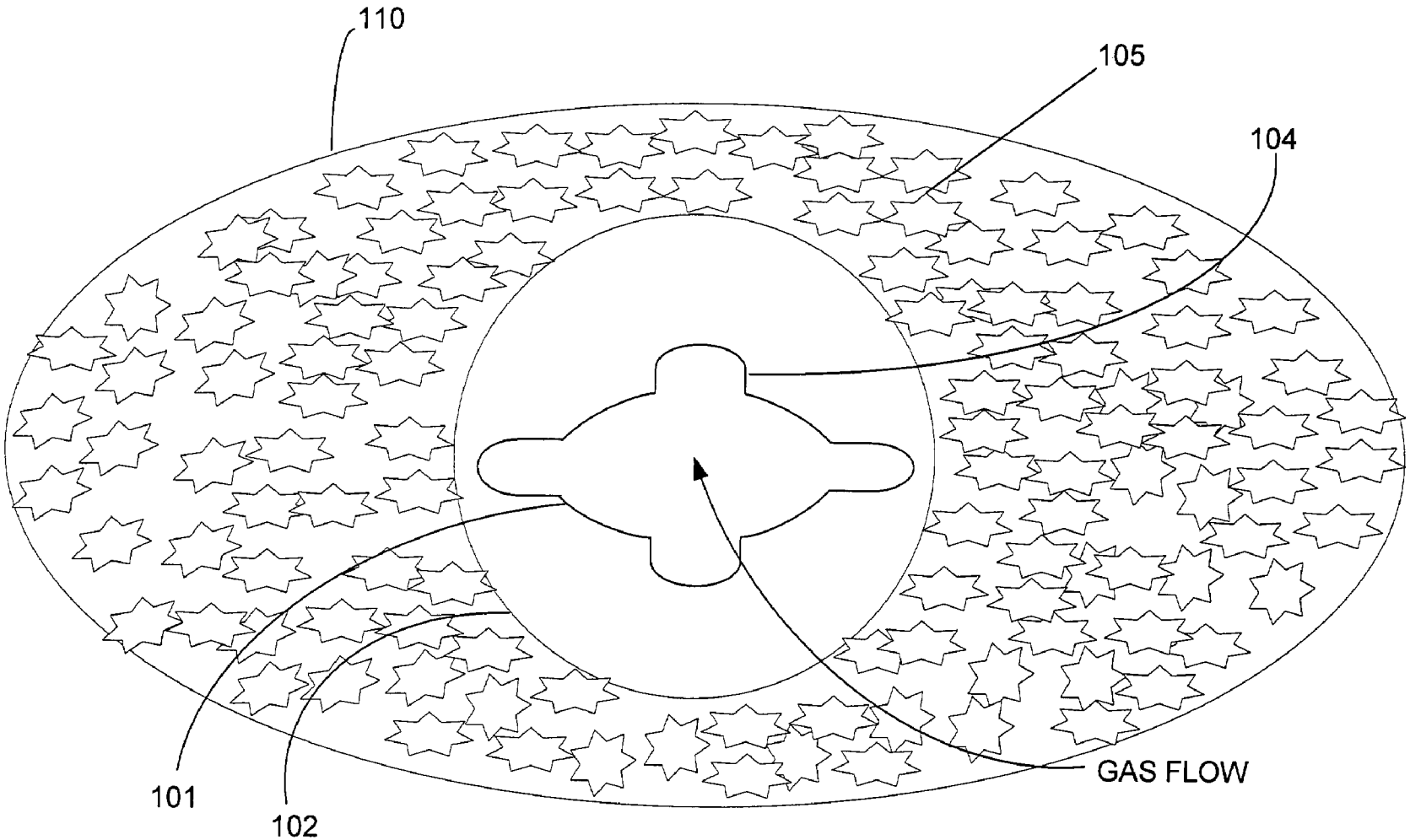
FIG. 6 illustrates a cross section diagram that can embody this invention incorporating an oval fluted channel or perforated material surrounded by a tube.

Other embodiments, such as illustrated in FIG. 6, can include a round or oval shape outer tube 102, and oval solid wall 110 with a round or oval inner tube 101 with outward pointed or inward directed flutes 104.

Figure 7A:
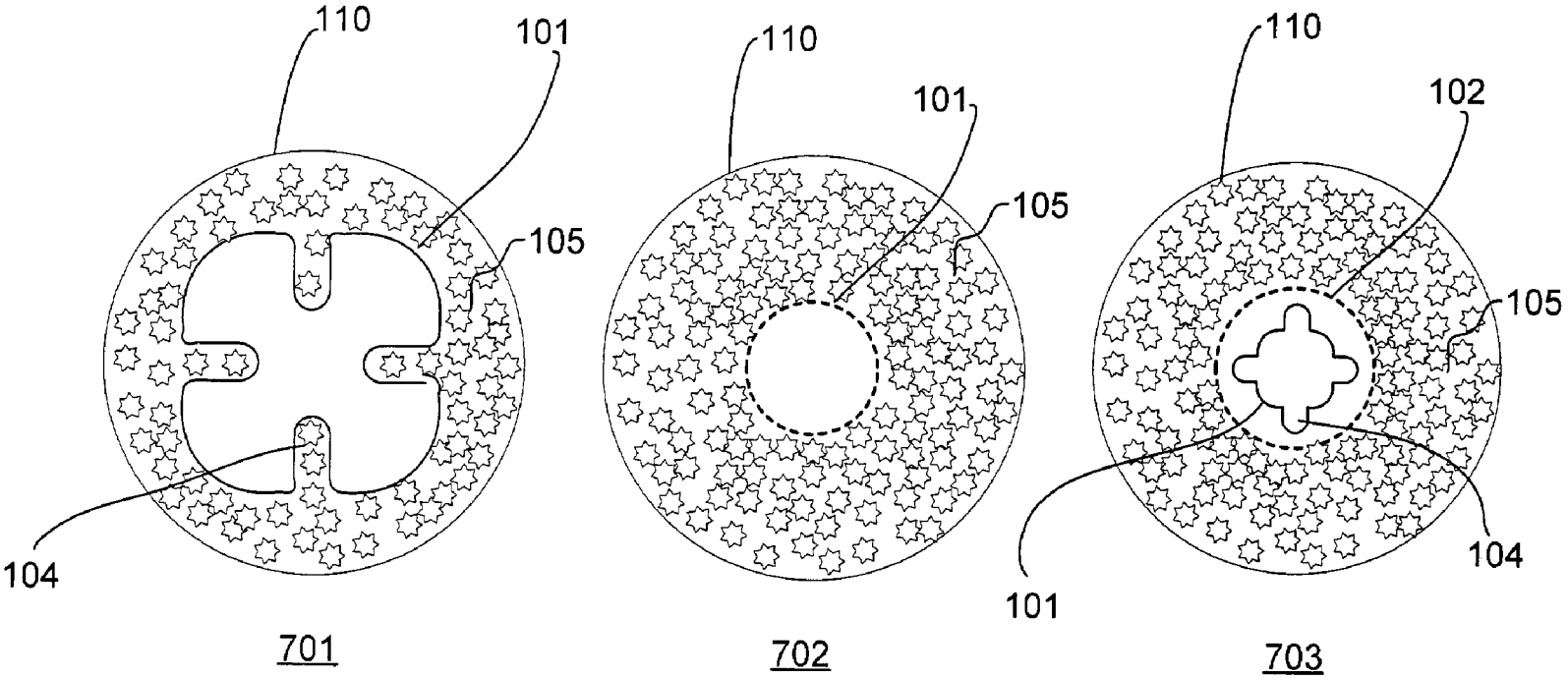
FIGS. 7A and 7B illustrate various cross section embodiments of the present invention.
Figure 7B:
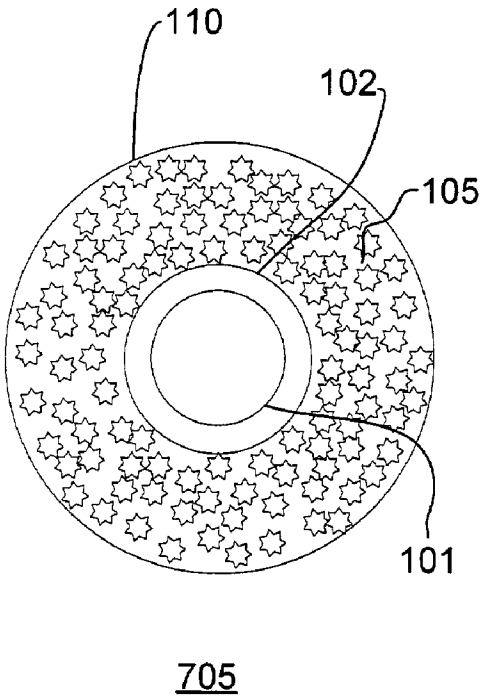
Figure 7B:
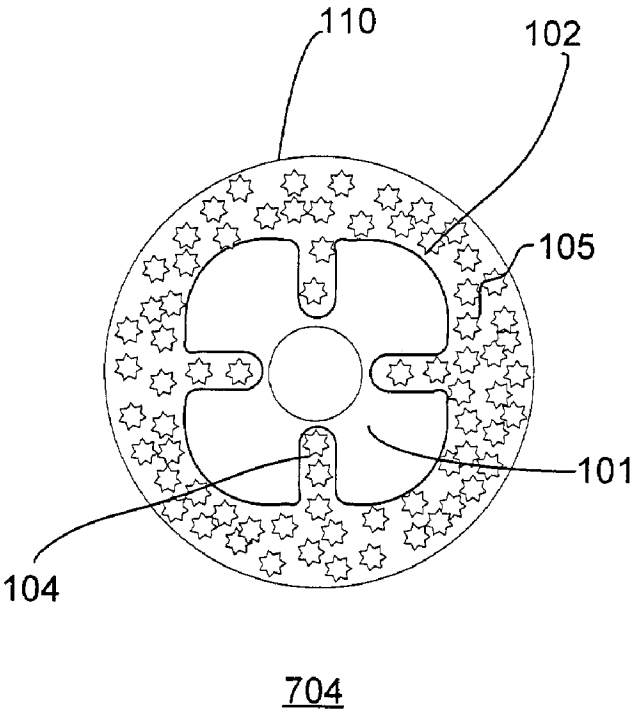

Referring now to FIGS. 7A and 7B, cutaway illustrations are shown of various embodiments of the present invention 701-705. The embodiments, can include, at 701, first perforated tube 101 with inward directed flutes 104 and no second perforated tube; at 702 a single perforated tube 101 with no second perforated tube 102; at 703, an outer tube with an inner tube 101, wherein the inner tube 101 has outward directed flutes 104; at 704, a first perforated tube 101 and a second perforated tube 102 with inward directed flutes 104 with infill 105 in the flutes 104 and around the second perforated tube 102; and at 705 a first perforated tube 101 and a second perforated tube 102 with infill 105 around the second perforated tube.

A number of embodiments of the present invention have been described. Nevertheless, it will be understood that various modifications may be made without departing from the spirit and scope of the invention. For example, all measurements can be modified to accommodate different sources of noise. Many variations in size, length, diameters and construction materials can be made while maintaining the basic tenets of the underlying invention. Dimensions can be optimized for maximum noise reduction or minimum power drop. The inventive concepts described herein can also be applied to small engines such as motorcycles, lawn mowers, chain saws, weed trimmers, power blowers and the like and other small engines. In addition, the inventive concepts can be incorporated into larger sources of noise, such as industrial engines, power plants and the like. Accordingly, other embodiments are within the scope of the following claims.

What is claimed is:

1. A sound attenuating apparatus for routing combustion gases from a combustion engine and boosting power, the apparatus comprising:

a first perforated tube having a first diameter;

flutes formed into the first perforated tube extending outward from the first perforated tube;

a diffuser portion with an outlet end connected to an inlet end of the first perforated tube, wherein the diffuser portion comprises a solid walled tube and the diameter of the solid walled tube at an inlet end is less than the diameter at the outlet end and the diameter of the inlet comprising the smallest diameter portion routing combustion gases;

an outer solid wall tube located concentrically around the outer surface of the first perforated tube; and side walls at either end of the solid walled tube wherein each side wall has an opening through which the inner perforated tube can connect to the diffuser portion and a tail portion.

2. The sound attenuating apparatus of claim 1 further comprising a second perforated tube having a second diameter which is greater than the first perforated tube, but less than the solid wall tube, the second perforated tube located concentrically around the first perforated tube.

3. The sound attenuating apparatus of claim 2 further comprising infill material packed in between an outer surface of the second perforated tube and an inner surface of tile solid walled tube.

4. The sound attenuating apparatus of claim 2 wherein the inner perforated tube and the outer perforated tube comprise stainless steel.

5. The sound attenuating apparatus of claim 2 wherein the inner perforated tube, the outer perforated tube and the solid wall tube comprise steel.

6. The sound attenuating apparatus of claim 2 wherein at least one of the inner perforated tube and the outer perforated tubes comprises ceramic.

7. A sound attenuating apparatus for routing combustion gases from a combustion engine and boosting power, the apparatus comprising:

a first perforated tube with an inlet end and an outlet end and a generally constant diameter;

an inlet pipe with a diameter suitable for connecting to an automobile exhaust system and comprising the smallest diameter portion through which exhaust gas will be routed;

a diffuser portion with an inlet end and an outlet end, the inlet end is connected to the inlet pipe and the outlet end of the diffuser portion is connected to the inlet end of the first perforated tube, wherein the diffuser portion comprises a solid walled tube with a diameter at the inlet end of the diffuser that is less than the diameter at the outlet end of the diffuser portion;

a second perforated tube having a diameter greater than the first perforated tube and located concentrically around the first perforated tube;

an outer solid walled tube having a diameter greater than the second perforated tube and located concentrically around the second perforated tube;

infill material within the outer solid walled tube and about the perimeter of the second perforated tube; and side walls at either end of the second perforated tube and the solid walled tube, wherein each side wall has an opening through which the perforated tube can connect to the diffuser portion and a tail portion.

8. The sound attenuating apparatus of claim 7 additionally comprising:

multiple flutes formed into one of the first anda second perforated tube wherein infill material is additionally located around the flutes.

9. A method for attenuating sound associated with an internal combustion engine, the method comprising:

placing an apparatus in the path of the combustion gases, wherein the apparatus comprises:

a first perforated tube of conical shape with a smaller diameter opening on one end of the tube and a larger diameter opening on the other end of the tube;

a second perforated tube located concentrically around the first perforated tube and generally following the shape of the first perforated tube with the diameter of any portion of the second perforated tube proportionately larger than the first perforated tube;

an outer solid walled tube having a diameter greater than the second perforated tube and located concentrically around the second perforated tube; and an outer solid walled tube having a diameter greater than the second perforated tube and located concentrically around the second perforated tube; and side walls connecting the respective ends of the second perforated tube and the solid walled tube with an opening through each side wall through which the inner perforated tube connects to an entry portion and a tail portion; and increasing the surface area of the flutes until a required amount of sound attenuation is accomplished.

10. The method of claim 9 wherein increasing the length of the first perforated tube, the second perforated tube and the outer walled tube increases the amount of sound attenuation.

11. The method of claim 9 wherein the surface area of the flutes is increased by adding additional flutes.

* * * * *